US010562307B2

(12) United States Patent
Coma Vives et al.

(10) Patent No.: US 10,562,307 B2
(45) Date of Patent: Feb. 18, 2020

(54) PRINTHEAD MAINTENANCE

(71) Applicant: Hewlett-Packard Development Company, L.P., Houston, TX (US)

(72) Inventors: Marta Coma Vives, Barcelona (ES); María Dinares Argemi, Terrassa (ES); David Butinya, Sant Cugat del Valles (ES); Macia Solé Pons, Sant Quirze del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/763,949

(22) PCT Filed: Jan. 29, 2016

(86) PCT No.: PCT/EP2016/051956

§ 371 (c)(1),
(2) Date: Mar. 28, 2018

(87) PCT Pub. No.: WO2017/129260

PCT Pub. Date: Aug. 3, 2017

(65) Prior Publication Data

US 2018/0264819 A1 Sep. 20, 2018

(51) Int. Cl.

| | |
|---|---|
| ***B41J 25/316*** | (2006.01) |
| ***B41J 2/165*** | (2006.01) |
| ***B41J 2/21*** | (2006.01) |

(52) U.S. Cl.
CPC ..... *B41J 2/16508* (2013.01); *B41J 2/16585* (2013.01); *B41J 2/2107* (2013.01)

(58) Field of Classification Search
CPC .... B41J 2/165; B41J 2/16505; B41J 2/16508; B41J 25/34; B41J 25/316
See application file for complete search history.

(56) References Cited

U.S. PATENT DOCUMENTS 6,305,786 B1 * 10/2001 Plotkin ..... B41J 25/34 347/50
8,579,421 B2 11/2013 Ito et al.
(Continued)

FOREIGN PATENT DOCUMENTS

CN 102092194 6/2011
CN 102233735 11/2011
(Continued)

OTHER PUBLICATIONS

Xia, Zhenhua, et al., "Flow Patterns in the Sedimentation of an Elliptical Particle", Journal of Fluid Mechanics, Apr. 14, 2009, pp. 249-272, vol. 625.

*Primary Examiner* — Scott A Richmond
(74) *Attorney, Agent, or Firm* — HP Inc. Patent Department

(57) ABSTRACT

Example methods for the maintenance of printheads are provided, the printheads comprising a reservoir containing a printing fluid with particles in suspension, and a nozzle plate. Example methods may comprise capping the nozzle plate of the printhead, and rotating the capped printhead. Example maintenance devices for printheads are also provided, comprising a support with a socket to attach a printhead to the support, a drive unit to rotate the support about a rotation axis, and a control unit connected to the drive unit to perform a predetermined rotation cycle.

19 Claims, 4 Drawing Sheets

(56) References Cited

U.S. PATENT DOCUMENTS

| | | | | |
|---|---|---|---|---|
| 9,079,439 | B2 | 7/2015 | Leoni et al. | |
| 2003/0231222 | A1* | 12/2003 | Jefferson | B41J 2/16511 347/29 |
| 2007/0091139 | A1* | 4/2007 | Takatsuka | B41J 2/16511 347/29 |
| 2009/0179945 | A1 | 7/2009 | Hibbard | |
| 2010/0029490 | A1* | 2/2010 | Pierik | B01J 19/0046 506/7 |
| 2012/0092403 | A1 | 4/2012 | Profaca | |
| 2013/0271517 | A1 | 10/2013 | Leoni et al. | |
| 2015/0258824 | A1* | 9/2015 | Goren | B41J 25/34 347/37 |
| 2018/0147866 | A1* | 5/2018 | Ramis Llinares | B41J 15/046 |
| 2018/0215180 | A1* | 8/2018 | Pawlowski | B41J 2/17 |

FOREIGN PATENT DOCUMENTS

| | | |
|---|---|---|
| CN | 102442076 | 5/2012 |
| CN | 103313855 | 9/2013 |
| EP | 1375157 | 1/2004 |
| EP | 2383120 | 11/2011 |
| JP | H05338195 | 12/1993 |
| JP | 2002200766 | 7/2002 |
| JP | 2015013375 | 1/2015 |
| KR | 100992192 | 11/2010 |

* cited by examiner

PRINTHEAD MAINTENANCE

BACKGROUND

Some printheads, for example inkjet printheads, comprise a reservoir containing printing fluid with particles in suspension, and a nozzle plate with a plurality of nozzles for ejecting printing fluid from the reservoir towards a printing substrate. Furthermore, in some large format printing apparatus each of the printheads is connected to a tank of printing fluid, which maintains the reservoir of the printhead supplied with printing fluid.

Some printing fluids, such as for example white inks, some metallic inks, or magnetic inks, comprise particles of pigment or additives which tend to precipitate. Maintenance processes, such as spitting, priming or constant recirculation of printing fluid in and out of the printheads, may be implemented when printheads for such printing fluids are not in use, in order to prevent the particles from depositing on the nozzles.

BRIEF DESCRIPTION

Non-limiting examples of the present disclosure are described in the following with reference to the appended drawings, in which.

Figure 3A:
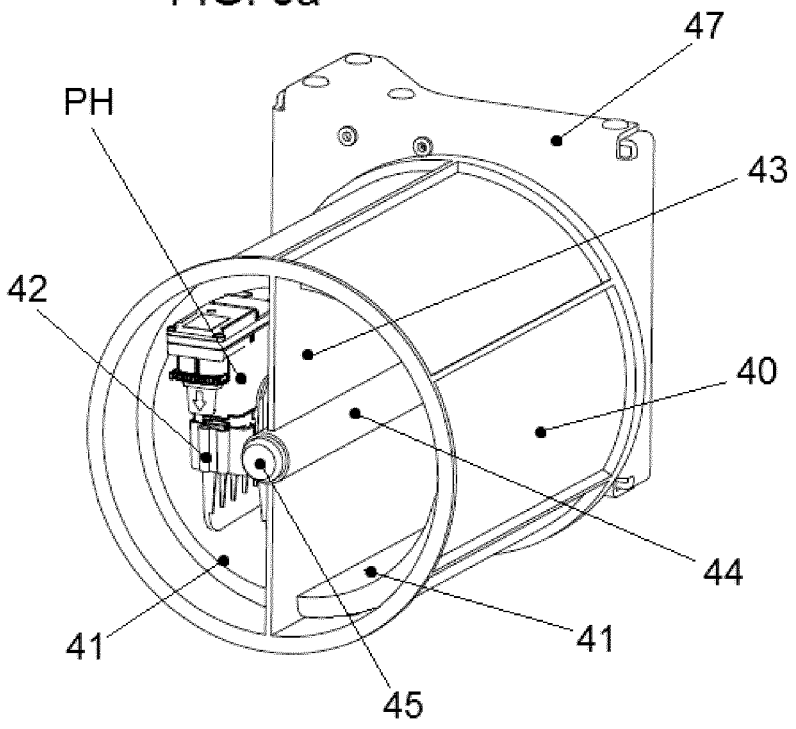
Figure 3B:
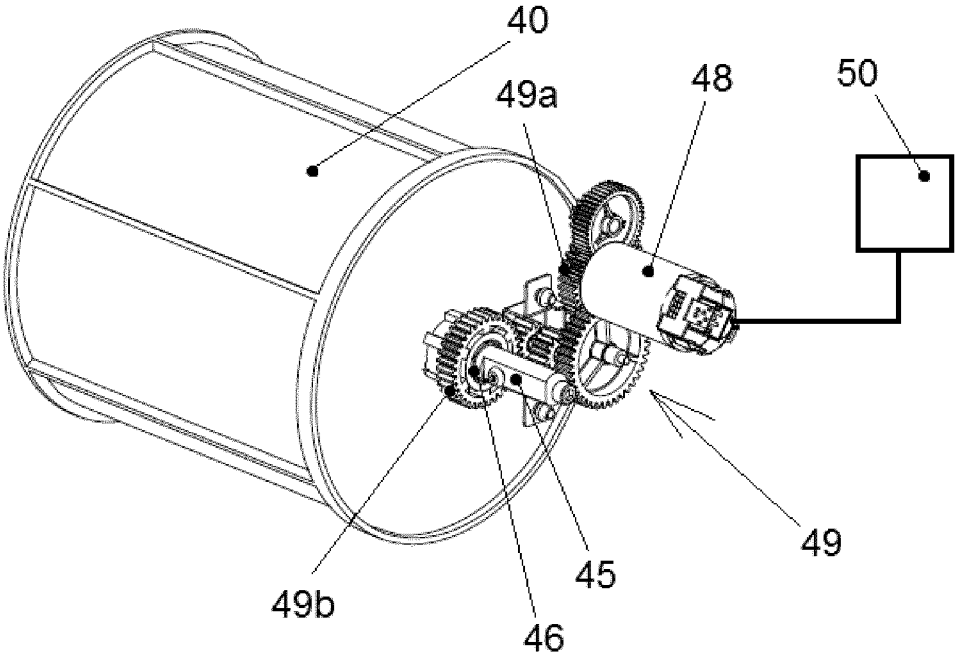
Figure 4:
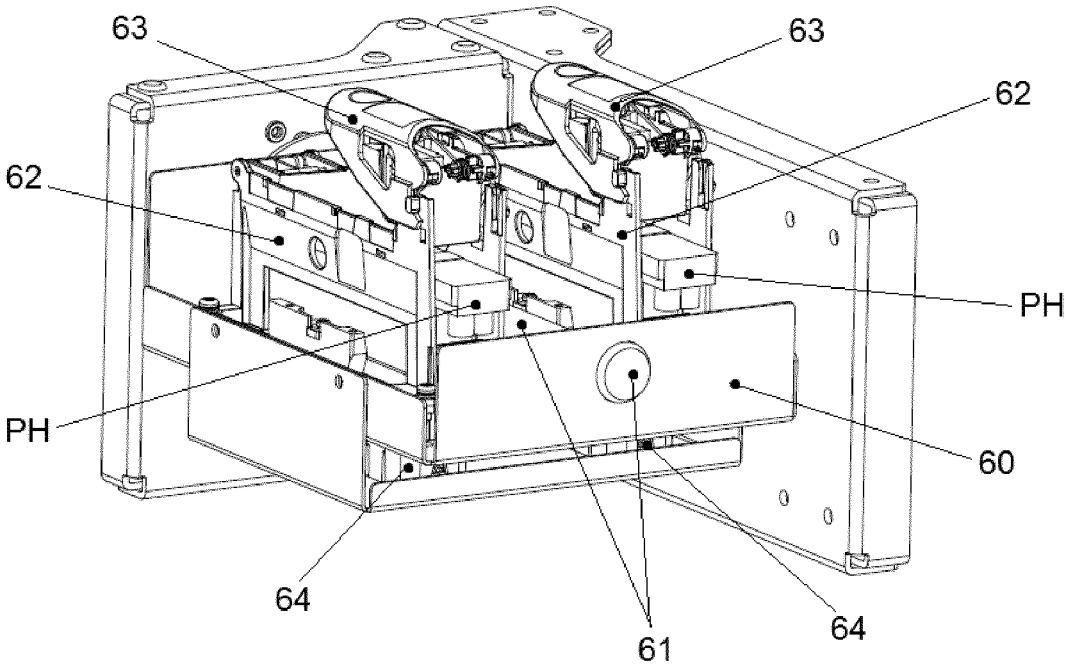
Figure 5:
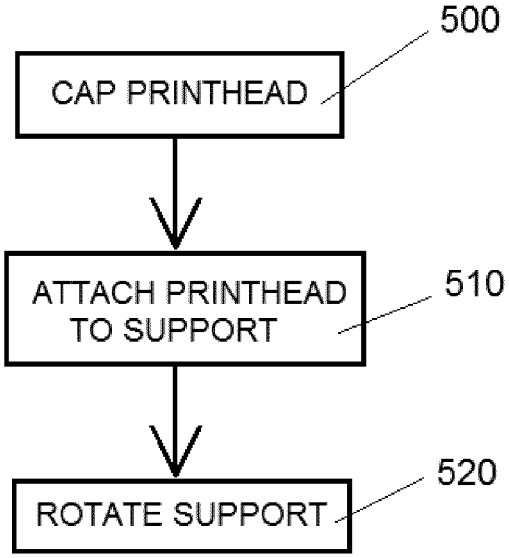
Figure 6:
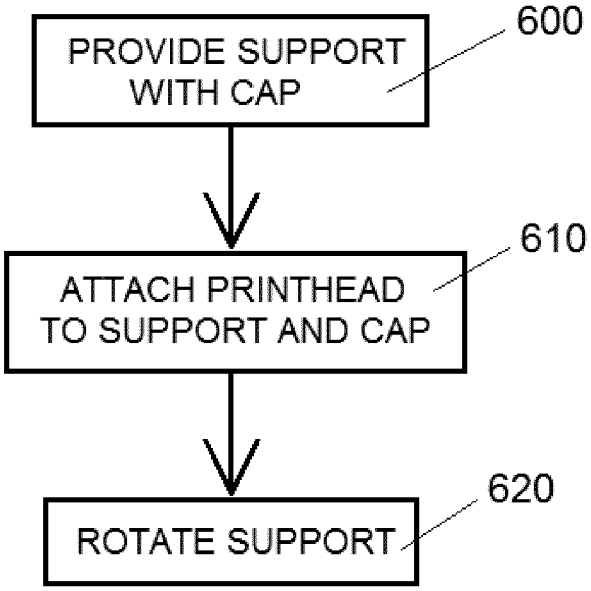
Figure 7:
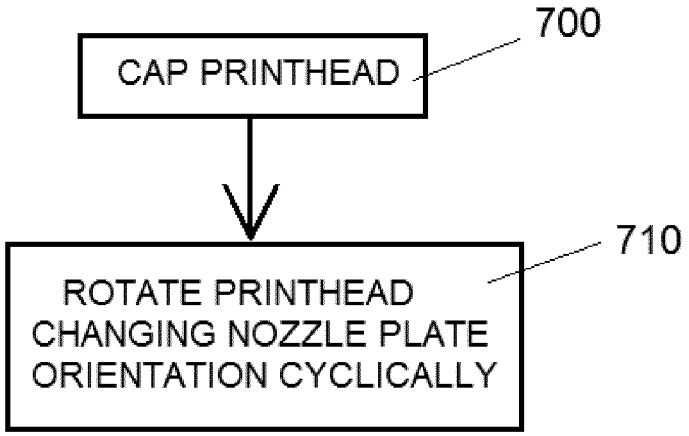

FIGS. 3*a* and 3*b* are schematic front and rear perspective views, respectively, illustrating an example of a maintenance devices according to some implementations;

FIG. 4 is a schematic perspective view showing an example of a maintenance device according to some implementations;

FIGS. 5, 6 and 7 are flowcharts illustrating examples of methods for the maintenance of printheads in accordance with examples disclosed herein.

DETAILED DESCRIPTION

Disclosed herein are maintenance processes for printheads, for example for printheads with printing fluids having particles, dissolved or in suspension, that tend to precipitate, such as for example particles of certain pigments and additives that provide special characteristics to the printouts. Example of such printing fluids may be white inks, some metallic inks, magnetic inks and others.

The printheads may comprise a reservoir containing printing fluid and a nozzle plate with a plurality of nozzles for ejecting printing fluid from the reservoir towards a printing substrate. A number of printheads with different printing fluids may be mounted on a reciprocating carriage in a printing apparatus, and each printhead may be connected through a tube to a tank of printing fluid mounted in a stationary part of the printing apparatus. The tank maintains the reservoir of the printhead supplied with printing fluid.

Some kind of agitation of the printing fluid in the tanks may be provided to prevent the precipitation of printing fluid particles. Maintenance of the printheads when they are not in use may also be convenient in order to prevent particles from precipitating inside the reservoir of the printhead, because this may, for example, cause clogging of the nozzles and/or it may affect the printing fluid properties.

When the printheads are not going to be in use for some time, for example overnight or for a couple of days, the printheads may be provided for example with two ports, for the inlet and outlet of fluid, respectively, and continuously recirculate printing fluid in and out of the printhead. This creates turbulences in the printhead reservoir that reduce the precipitation of the particles. However, even with this recirculation, there may be a certain degree of precipitation in the printhead reservoir, and nozzles still tend to clog with time.

The printheads may be serviced by spitting and/or priming, such as to remove and discard precipitated particles and replace the printing fluid near the nozzles with new fresh fluid. These servicing operations may be performed for example before resuming printing with a printhead that has been subject to recirculation as described above, in order to, for example, recover the nozzles that become clogged with time. The intensity of the servicing operations depends on the time during which the printhead has not been in use, and a large amount of printing fluid may be wasted in order to recover a printhead that has been idle and subject to recirculation for several days.

Before resuming printing the printheads may also be removed from the printing apparatus and shaken manually. However, depending on the time lapsed and on how blocked the nozzles have become, even manual shaking may fail to restore the printheads to a condition allowing quality printing. Furthermore, this manual maintenance operation relies on the skill of the user, and there is a risk that the operation is not performed at the right times.

Figure 1:
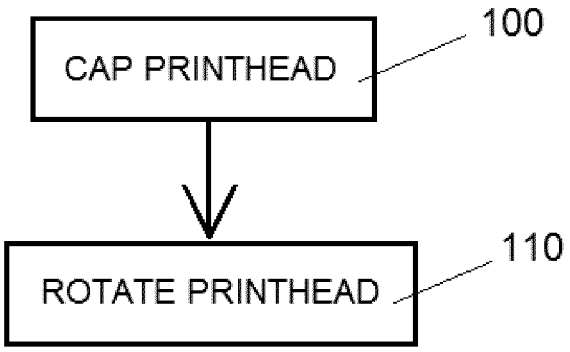
FIG. 1 is a flowchart illustrating examples of methods for the maintenance of printheads according to implementations disclosed herein.

As illustrated in FIG. 1, some examples of methods for the maintenance of a printhead disclosed herein comprise, in block 100, capping the nozzle plate of the printhead and, in block 110, rotating the capped printhead according to a predetermined rotation cycle.

The predetermined rotation cycle is such that the particles in suspension in the printing fluid, which may tend to precipitate, circulate by gravity within the printing fluid as a consequence of the rotation, and tend to remain in motion inside the reservoir.

Large and/or heavy particles of the printing fluid, which have a higher tendency to precipitate, are more affected by the rotation and by gravity. The particles that tend to precipitate may therefore remain in suspension in the printing fluid, and the risk of precipitation and of clogging of the nozzles is reduced. The printheads may be maintained in good condition even if they are not used for days or weeks, and may be used again for printing without performing servicing operations, or with quicker and less severe servicing than when they have been subject to recirculation.

Figure 2:
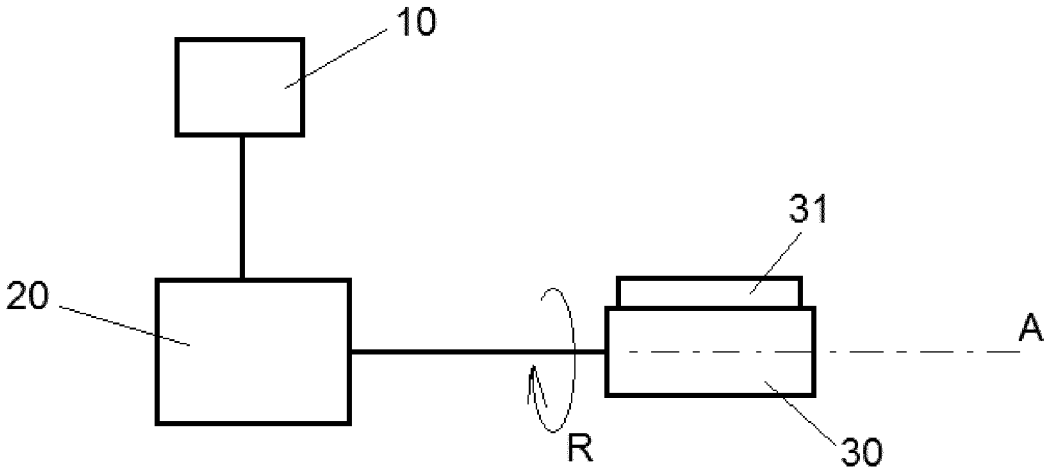
FIG. 2 is a diagram showing an example of a maintenance device for printheads as disclosed herein.

Also disclosed herein are implementations of maintenance devices for printheads, as shown for example in FIG. 2, comprising a control unit 10, a drive unit 20, and a support 30 with a socket 31 for attaching a printhead to the support 30.

Under the control of the control unit 10, the drive unit 20 may rotate the support 30 about an axis A so that a printhead that is attached to the socket 31 is subjected to a predetermined rotation cycle, for example represented by arrow R in FIG. 2.

A drive unit, such as drive unit 20, refers herein to a power and transmission system to rotate the support 30 about axis A, as convenient. A control unit, such as control unit 10, refers herein to an electronic device comprising an input device, a processing device, a memory and an output device, allowing the control of the drive unit to perform a maintenance operation as disclosed herein. Examples of drive units and control units are given below.

FIGS. 3*a* and 3*b* respectively show front and rear perspective views of an example of a maintenance device in accordance with some implementations.

In FIG. 3*a*, in some implementations the support of the maintenance device comprises a drum 40 with sockets 41 for attaching printheads (one printhead PH being shown in FIG. 3*a*), the sockets 41 being mounted inside the drum 40, such that the printheads remain protected. The drum 40 may be mounted on a shaft and rotated, as described below. The drum 40 may be cylindrical, as shown, but it may also have other shapes, for example prismatic.

The printhead PH is depicted in FIG. 3*a* with its nozzle plate capped with a suitable cap 42, which in this case may be fitted to the printhead PH before inserting the printhead PH into the drum 40 and attaching it to a socket 41.

The sockets 41 may hold the printheads by shape matching and/or by pressure fit, and the sockets may comprise some cushioning material such as rubber foam. The sockets 41 may also comprise e.g. a spring clip (not shown) to secure the printheads.

The drum 40 may have a partition wall 43 on which a tube 44 is formed, by which the drum 40 may be rotatably mounted around a shaft 45. The end of the shaft 45 may be attached to a frame 47.

FIG. 3*b* also shows an example implementation of a drive unit for rotating the drum 40, which may comprise a motor 48 attached to the frame 47, and a gear transmission 49 between a driving gear wheel 49*a* keyed to the shaft of the motor 48 and a driven gear wheel 49*b* that is mounted around the shaft 45 with the interposition of a bearing 46 and is fixed to the drum 40. The frame 47 has been omitted from FIG. 3*b* in order to show the gear transmission 49 and the bearing 46. The transmission 49 may reduce the speed of rotation of the motor 48 to provide a suitable rotation speed, or a suitable range of rotation speeds, to the drum 40.

The motor 48 may be connected to a control unit 50, which may comprise a processor resource and a memory resource. For example, the control unit may include a microprocessor, an input device such as a keyboard to allow the user to enter data such as the type of printhead that is being placed in the drum 40, and a memory for storing data, e.g. data of the predetermined rotation cycles to be applied to the drum 40. The control unit 50 may be a dedicated control unit for the maintenance device, or it may be the control unit of a printing apparatus on which the maintenance device is mounted.

In the implementation of the drive unit of FIG. 3*b*, the gear transmission 49 allows the drum 40 to be rotated in both directions, and also to be manually rotated by a user. Other implementations of the drive unit are possible, for example comprising a motor and a worm drive (not shown) which has a non-reversible direction of transmission and does not allow the manual rotation of the drum 40 by the user.

Some implementations of a drive unit may also comprise an encoder (not shown) connected to the control unit and placed to detect the rotation of the drum 40.

FIG. 4 shows a maintenance device in accordance with some implementations.

The maintenance device may comprise a tray 60, which is rotatably mounted around a shaft 61. Two pen pockets 62 may be mounted on the tray 60 as sockets for the printheads. The pen pockets 62 may be similar to those employed in a printing apparatus for the insertion of the printheads for printing, for example on a reciprocating carriage of the printing apparatus. As visible in FIG. 4, each pen pocket 62 may comprise a lever 63 that may be opened to insert a printhead PH and closed again to secure the printhead PH in place.

The tray 60 may be driven in rotation by a drive unit under the control of a control unit such as described in relation to FIG. 3*b* to subject the printheads to a predetermined rotation cycle.

In some implementations the support, such as the drum 40 or the tray 60 of the implementations of FIGS. 3*a*, 3*b* and of FIG. 4, may comprise sockets for having two printheads PH attached to the support at the same time.

As also shown for example in FIGS. 3*a*, 3*b* and in FIG. 4, a socket may be placed in the support such as to attach the printhead in a position whereby the nozzle plate of the printhead is not substantially perpendicular to the rotation axis of the support. For example the nozzle plate may be parallel to the rotation axis of the support, as in FIGS. 3*a*, 3*b* and in FIG. 4.

In some implementations of a maintenance device, the socket comprises a cap for capping the printhead when the printhead is attached to the maintenance device, such that the user does not cap the printhead manually but the printhead becomes capped automatically upon its attachment to the socket. This simplifies the manual operations the user has to perform.

For example, in implementations such as shown in FIGS. 3*a* and 3*b* the cap (not shown) may be installed inside the drum 40, in such a way that a user may insert a printhead horizontally into the drum 40 and in correspondence with the socket 41, and at the end of the movement the printhead encounters a sloped surface and is guided in a vertical direction until it is applied against the cap, and therefore capped. A spring clip (not shown) may provide additional securing of the printhead.

In implementations such as shown in FIG. 4, the cap 64 may be installed under the pen pocket. When the printhead is inserted into the pen pocket 62 with a vertical movement, it comes to rest against the cap 64. The printhead is then capped when it is urged to descend further in the pen pocket, as the lever 63 is closed to secure the printhead.

A maintenance device according to implementations described above may be attached to the frame of a printing apparatus that employs printing fluids with particles that tend to precipitate, to store the printheads with such printing fluid when they are not in use. In such cases, the drive unit of the maintenance device may be as described above, may be integrated with a drive unit of the printing apparatus, for example by providing a transmission from a shaft of the printing apparatus to the rotatable support of the maintenance device, a combination thereof, or the like. Furthermore, the maintenance device may be controlled through the control unit of the printing apparatus, instead of having its own microprocessor, memory, etc.

For example, a device such as illustrated in FIG. 3*a*, 3*b* or in FIG. 4 may be attached to the frame of a printing apparatus.

In some implementations, a maintenance device as described above may also be a stand-alone device, or a maintenance kit to be attached to a printing apparatus.

Some implementations of methods for the maintenance of a printhead as disclosed herein may comprise attaching the printhead to a rotatable support, such as for example the support 30 disclosed in FIG. 2, and rotating the support according to a predetermined rotation cycle.

Some implementations of the method may be performed by placing a printhead in a maintenance device, for example a device according to implementations disclosed herein.

According to some examples of maintenance methods, predetermined rotation cycles may be performed on a printhead for several hours or for several days, and even weeks, and may, for example, maintain the printheads in good operating conditions, without significant particle precipitation occurring during this time. Tests have shown that printheads are in good condition even after two months if subject to rotation as in some examples disclosed herein.

Since implementations of the method disclosed herein may be carried out without intervention from the user for manually shaking or agitating the printheads, they allow reducing the risk of inadequate interventions on the printheads, due for example to the lack of experience of a user.

Furthermore, the predetermined rotation cycle may depend on the properties of each kind of printing fluid and printhead, such as density and kind of particles of the printing fluid, geometry of the printhead, and others, in order to improve the result in each case.

The amount of printing fluid wasted in the maintenance operation in some examples of the disclosed method may be very small, or almost zero.

Printheads may be removed from a printing apparatus, for example from a printhead carriage, in order to be subject to implementations of methods disclosed herein, when it is foreseen that the apparatus is not going to be used for some time, such as for example during a weekend, or when individual printheads are not going to be employed for some time because the next batch of jobs use printing fluids such as CMYK inks (Cyan, Magenta, Yellow and Black), in which particles have less tendency to precipitate.

Once removed from the printing apparatus, the printheads may be subject to a maintenance operation as disclosed herein until the printheads are to be employed for printing again. At this point the predetermined rotation cycle may be stopped, and the printheads may be installed to print in the printing apparatus.

Implementations of the maintenance method and maintenance device as disclosed may also be employed for spare or extra printheads during storage, thus, for example, reducing the risk of the nozzles becoming clogged or the properties of the printing fluid suffering a significant decline during storage.

Some implementations comprise capping the printhead before attaching the printhead to a rotatable support. For example, as shown in FIG. 5, the method may comprise, in block 500 capping the nozzle plate of the printhead, in block 510 attaching the capped printhead to a rotatable support, and in block 520 rotating the support with the capped printhead, according to a predetermined rotation cycle.

Some other implementations of the method comprise, for example as illustrated in FIG. 6, in block 600 providing a rotatable support that comprises a cap for the printhead, in block 610 attaching the printhead to the support thereby causing the printhead to be capped, and in block 620 rotating the support with the capped printhead, according to a predetermined rotation cycle.

Some implementations of methods disclosed herein involve rotating the printhead about a rotation axis that is positioned such that the orientation of the nozzle plate changes with the rotation: i.e. an axis that is not substantially perpendicular to the nozzle plate.

During each revolution of the printhead, the change in the orientation of the nozzle plate (for example from horizontal to vertical, then horizontal again but upside down with respect to the first position, and so on) causes the particles that are in suspension in the printing fluid and are subject to gravity to first move away from the nozzle plate, and successively move towards the nozzle plate again, as the nozzle plate changes its orientation.

In some implementations, such as illustrated in FIG. 7, methods for maintaining a printhead comprise in block 700 capping the nozzle plate of the printhead, and in block 710 rotating the capped printhead such that the orientation of the nozzle plate changes cyclically.

A predetermined rotation cycle, as used herein, may be defined as a movement of rotation which may comprise rotating the printheads at certain speeds for certain intervals of time, in a sequence which is repeated along time.

In some implementations the predetermined rotation cycle comprises continuous rotation. For example, the printhead may be rotated at a predetermined constant rotational speed, for example a rotational speed of between 0.5 and 5 rpm (revolutions per minute). In some examples the rotational speed may be for example of about 1 rpm.

In some implementations the predetermined rotation cycle may comprise intermittent rotation, and/or alternate rotation in opposite directions. For example, the predetermined rotation cycle may comprise periods of rotation at a constant speed and periods where the printhead is stopped (i.e. the rotational speed is zero): for example, rotating at constant speed, for example at a speed of between 0.5 and 5 rpm, during an interval of between 10 seconds and 2 minutes, and then stopping during an interval of between 10 minutes and 2 hours. In some examples the predetermined rotation cycle may comprise rotating the printhead through an angle to change the orientation of the nozzle plate, e.g. 190°, then stopping during a time interval, for example between 1 and 60 minutes, for example 30 minutes, and repeating this cycle until the printhead is going to be employed again for printing. The position of the printhead when it is stopped changes after each rotation, and along time the particles are circulated by gravity in all directions.

In some implementations, the predetermined rotation cycle depends on the printing fluid. For example, for a printhead of white ink the predetermined rotation cycle may involve a rotation of 190° at 1 rpm every 30 minutes. For printing fluids that have a higher density, the frequency for example may be different, and the predetermined rotation cycle may involve for example a rotation of 190° at 1 rpm every 10 minutes.

Although a number of particular implementations and examples have been disclosed herein, further variants and modifications of the disclosed devices and methods are possible. For example, not all the features disclosed herein are included in all the implementations, and implementations comprising other combinations of the features described are also possible.

The invention claimed is:

1. A method for the maintenance of a printhead, the printhead comprising a reservoir containing a printing fluid with particles in suspension, d a nozzle plate, the method comprising capping the nozzle plate of the printhead, and rotating the capped printhead through a number of complete rotations according to a predetermined rotation cycle to cause the particles in suspension to circulate by gravity within the printing fluid in the reservoir.

2. The method of claim 1, comprising attaching the printhead to a rotatable support and rotating the support according to the predetermined rotation cycle.

3. The method of claim 2, comprising capping the printhead before attaching the printhead to the support.

4. The method of claim 2, comprising providing a cap for the printhead on the support, whereby the printhead is capped when the printhead is attached to the support.

5. The method of claim 1, wherein the predetermined rotation cycle comprises rotation in both rotational directions.

6. The method of claim 1, wherein the predetermined rotation cycle comprises intermittent rotation wherein a pause occurs between series of complete rotations.

7. The method of claim 1, wherein the predetermined rotation cycle depends on the printing fluid.

8. The method of claim 1, wherein the predetermined rotation cycle comprises rotating the printhead such that the orientation of the nozzle plate changes.

9. A method for the maintenance of a printhead, the printhead comprising a reservoir containing a printing fluid with particles in suspension, d a nozzle plate, the method comprising capping the nozzle plate of the printhead, and rotating the capped printhead such that the orientation of the nozzle plate changes cyclically by attaching the printhead to a rotatable support and rotating the support according to a predetermined rotation cycle, the method further comprising capping the printhead before attaching the printhead to the support.

10. A maintenance device for printheads, comprising a support comprising a socket to attach a printhead to the support, a drive unit to rotate the support about a rotation axis, and a control unit connected to the drive unit to perform a predetermined rotation cycle comprising a number of complete rotations of the printhead in which a nozzle plate of the printhead transitions from a horizontal orientation to a vertical orientation and back to a horizontal orientation during one rotation.

11. The device of claim 10, wherein the socket is to attach the printhead such that a nozzle plate of the printhead is not perpendicular to the rotation axis of the support.

12. The device of claim 11, wherein the socket is to attach the printhead such that the nozzle plate of the printhead is parallel to the rotation axis of the support.

13. The device of claim 10, wherein the socket comprises a cap for capping the printhead.

14. The device of claim 10, wherein the support comprises a drum with the socket placed inside the drum.

15. The device of claim 10, wherein the support comprises sockets for attaching two printheads to the support.

16. The device of claim 10, wherein the socket comprises a securing device to releasably secure a printhead in the socket.

17. The device of claim 10, further comprising a transmission between the drive unit and the support to educe a rotational speed of the drive unit so as to rotate the support at a reduced speed from the rotational speed of the drive unit.

18. The device of claim 16, wherein the securing device comprises a lever that also urges the printhead into engagement with a cap on the support when closed.

19. The device of claim 10, wherein the control unit is to operate the drive unit to rotate the support with intermittent rotation wherein a pause occurs between predetermined rotation cycles at a set rotational speed between 0.5 and 5 rotations per minute.

* * * * *